US006128895A

United States Patent [19]

Takahama et al.

[11] Patent Number: 6,128,895

[45] Date of Patent: Oct. 10, 2000

[54] STEAM COOLING APPARATUS FOR GAS TURBINE

[75] Inventors: Masayuki Takahama; Yasuhiro Hashimoto; Yoshinori Kita; Tomoka Tanaka, all of Takasago, Japan

[73] Assignee: Mitsubishi Heavy Industries, Ltd., Tokyo, Japan

[21] Appl. No.: 09/147,724

[22] PCT Filed: Jun. 24, 1998

[86] PCT No.: PCT/JP98/02801

§ 371 Date: Apr. 29, 1999

§ 102(e) Date: Apr. 29, 1999

[87] PCT Pub. No.: WO98/59158

PCT Pub. Date: Dec. 30, 1998

[30] Foreign Application Priority Data

Jun. 24, 1997 [JP] Japan ..... 9-167238
Oct. 29, 1997 [JP] Japan ..... 9-297104

[51] Int. Cl.[7] ..... F02C 6/00

[52] U.S. Cl. ..... 60/39.182; 60/730

[58] Field of Search ..... 60/39.171, 39.182, 60/730

[56] References Cited

U.S. PATENT DOCUMENTS 4,476,674 10/1984 Berman ..... 60/39.182
5,428,950 7/1995 Tomlinson et al. .
5,918,466 7/1999 Cloyd et al. ..... 60/735
6,003,298 12/1999 Horner ..... 60/39.182

FOREIGN PATENT DOCUMENTS 5-141267 6/1993 Japan .
7-119413 5/1995 Japan .
9-112292 4/1997 Japan .
9-166002 6/1997 Japan .

*Primary Examiner*—Charles G. Freay
*Attorney, Agent, or Firm*—Oblon, Spivak, McClelland, Maier & Neustadt, P.C.

[57] ABSTRACT

The present invention relates to a steam-cooling system for gas turbine combustors in combined plants possessing a steam-cooled combustor; in order to maintain the combustor outlet steam temperature at planned values even during the starting and during the periods of load fluctuation, a steam valve 12 is opened and steam from a boiler 4 is conducted, and thereby the combustor of the gas turbine 1 is cooled, and steam recovery valve 11 is opened and this steam is returned to steam turbine 5. During the starting, steam is caused to flow from an auxiliary steam source 3, and a warming up is conducted. When the amount of steam at the combustor outlet decreases, the temperature of the temperature sensor 31 increases, and when this exceeds a planned value, a temperature regulating valve 30 is opened and steam from steam turbine 5 is extracted and is let into the cooling steam outlet side flow path 61 of the combustor. Furthermore, when the value of a pressure sensor 24 reaches a predetermined value, a bypass valve 14 is opened and steam is caused to flow to a condenser 6, and thus the necessary amount of steam is maintained within the combustor. This is all controlled by means of the controller 10, which constantly maintains the temperature of the cooling steam at planned values.

3 Claims, 7 Drawing Sheets

STEAM COOLING APPARATUS FOR GAS TURBINE

This application is a 371 of PCT/JP98/02801 filed Jun. 24, 1998.

TECHNICAL FIELD

The present invention relates to a device for steam cooling the combustor of a gas turbine which, in a combined plant in which a gas turbine and a steam turbine are combined, is capable of accurately controlling the temperature of the steam at planned temperatures even during periods of load change.

BACKGROUND ART

FIG. 7 is a schematic diagram of a plant having a gas turbine combustor which is subjected to steam cooling, in a combined plant in which a gas turbine and a steam turbine are combined. In the figure, a combustion gas 7, which is created as a result of power generation in gas turbine 1 and is discharged, is supplied to the boiler 4, and in boiler 4, steam 9 is generated by this high-temperature combustion gas 7 from the gas turbine 1, and the exhaust gas 50 is discharged to the atmosphere from smokestack 51. The steam 9, which is generated in the boiler 4, is supplied to steam turbine 5, and this turns a power generator, so that electric power is obtained. The cooling of the combustor of gas turbine 1 is conducted by extracting a portion of the steam produced by boiler 4 and conveying this steam 40 to the combustor, and the steam heated during this cooling process as recovered steam 41 is then reused by being returned to steam turbine 5.

Next, the control of the steam cooling for the gas turbine combustor in a combined plant having the structure described above will be explained.

FIG. 6 is a schematic flow diagram of a steamcooling system for gas turbine combustors in a conventional combined plant. In the figure, controller 2 controls the flow of the steam, while combustion gas from the gas turbine 1 is led to the boiler 4, which generates steam. Furthermore, this steam-cooling system is provided with an auxiliary steam source 3, a steam turbine 5, and a condenser 6. Steam recovery valve 11 is provided in the recovered steam flow path 61 from the outlet of the combustor of gas turbine 1. Furthermore, steam valve 12 is provided in extracted steam flow path 62 from the boiler 4 to the inlet of the combustor of gas turbine 1. Auxiliary steam valve 13 is provided in flow path 63 in order to introduce the steam from the auxiliary steam source 3 into the flow path 62 leading to the inlet of the combustor of gas turbine 1. The opening and closing of these valves 11 through 13 is controlled by the controller 2.

Furthermore, a temperature sensor 21, which detects the temperature of the steam flowing through the auxiliary steam flow path 63, a temperature sensor 22, which detects the temperature of the steam flowing into the inlet of the combustor of gas turbine 1, and a temperature sensor 31, which measures the temperature of the steam at the outlet of the combustor of gas turbine 1, are provided in the system, and the detected values detected by these temperature sensors are input into controller 2. In addition to the parts described above, an actual plant would be provided with a drain exhaust system, opening and closing valves, flow rate and pressure adjustment valves, pressure detectors, and the like; however, as these are not required for an explanation of the technological background of the present invention, an explanation thereof will be omitted here.

In a control system such as that described above, prior to supplying steam to the combustor of the gas turbine 1, the warming of the piping systems, and the discharge of the drain during operation, are conducted; however, those systems are omitted from the figures. Prior to starting, the auxiliary steam valve 13 is first opened, and auxiliary steam is allowed to flow into the auxiliary steam flow path 63 from auxiliary steam source 3, and this flows through the combustor of gas turbine 1 via flow path 62, and is discharged via a flush pipe which is not depicted in the figure, so that a warming up is conducted. Next, gas turbine 1 is started, and after a predetermined period of time, the auxiliary steam valve 13 is closed, while steam valve 12 and steam recovery valve 11 are opened, the steam extracted from the boiler 4 is supplied to the combustor of gas turbine 1, and the combustor is cooled using this steam, while the steam heated in the process of cooling is returned to steam turbine 5 and reused. The amount of cooling steam supplied to the combustor of gas turbine 1 is adjusted to the amount necessary for the gas turbine load by conducting programmed control in the controller 2.

As described above, when the signals of temperature sensors 21, 22, and 31 are input into the controller 2, the opening and closing of the auxiliary steam valve 13, the steam valve 12, and the steam recovery valve 11 is conducted in accordance with a program predetermined, and steam cooling is conducted so that the combustor of gas turbine 1 remains at planned temperatures from the starting of the gas turbine and throughout the operation thereof.

As described above, in conventional steam-cooling systems for gas turbine combustors in combined plants, the combustor is cooled using steam extracted from a boiler, and after it has been used for cooling, the steam is returned to the steam turbine as recovered steam, and the required amount of steam is controlled by a controller using a program determined in advance in accordance with the load on the gas turbine. However, during the starting in the plant, and during periods of load change, delays occur in response to the temperature and pressure of the steam generated at the boiler, and as a result of these delays, the steam employed for cooling the combustor is insufficient, so that there are cases in which the steam temperature in the flow path on the cooling steam outlet side of the combustor increases, and exceeds planned temperatures, so that the temperature of the combustor increases excessively. Furthermore, in order to counteract this insufficiency in the steam employed for cooling the combustor, it was necessary to increase the size of the boiler.

DISCLOSURE OF INVENTION

The present invention has as an object thereof to provide a steam-cooling system for gas turbine combustors which, in combined plants having a steam-cooled combustor, is capable of maintaining planned temperatures by preventing an excessive rise in steam temperature in the gas turbine combustor even during the starting of plant or during periods of load change.

The invention of the present application comprises a steam-cooling system for gas turbine combustors in combined plants, in which combustion gas exhausted from a gas turbine is directed to a boiler, steam is generated in this boiler and a steam turbine is operated using this steam while a portion of the steam from the boiler is extracted and supplied to the combustor of the gas turbine to cool the combustor, and after being used for this cooling, the steam is returned to the steam turbine; which comprises: a temperature sensor for detecting the temperature of steam in a cooling steam outlet side flow path of the gas turbine combustor; a steam flow path through which steam is extracted from the exhaust system of the steam turbine and the extracted steam from the exhaust system of the steam turbine is let into the cooling steam outlet side flow path of the gas turbine combustor via a temperature regulating valve; and a controller which receives detected temperature signals from the temperature sensor and conducts control such that the valve is opened when the detected temperature is in excess of a predetermined value, and closed the valve when this temperature is equal to or lower than the predetermined value.

The controller conducts control such that when the temperature of the steam at the cooling steam outlet side of the gas turbine combustor exceeds a planned temperature set in advance, the temperature regulating valve opens. When the temperature detected by the temperature sensor exceeds the planned value, the controller which receives this detected temperature signal controls opening operation of the valve, and this allows low-temperature steam extracted from the exhaust system of the steam turbine to enter into the cooling steam output side flow path of the gas turbine combustor, thus regulating temperature in such a way as to decrease the temperature of the steam flowing in the cooling steam outlet side flow path. Next, when the temperature of the steam in the flow path at the cooling steam outlet side of the combustor reaches the planned value, the valve is closed, and normal control resumes. By means of such control, it is possible to prevent an excessive rise in the steam temperature in the flow path at the cooling steam outlet side of the gas turbine combustor even during the starting of the plant or during fluctuations in the load, and it is thus possible to control the temperature so that it remains at planned values.

Another mode of the invention of the present application involves a steam-cooling system for gas turbine combustors, comprising a pressure sensor for detecting a difference in pressure between the inlet side flow path and the outlet side flow path of the cooling steam of the combustor, and a bypass flow path for allowing an outflow of steam from the cooling steam outlet side flow path of the combustor to the condenser via a bypass valve; a detected temperature signal from the temperature sensor and a pressure signal from the pressure sensor are input into the controller, and the controller conducts control such that when the detected temperature is higher than a predetermined value, the temperature regulating valve is opened, while when this temperature is equal to or lower than the predetermined value, the valve is closed, and furthermore conducts control such that when the pressure is lower than a predetermined value, the bypass valve is opened, while when the predetermined value is reached, the bypass valve is closed.

In the structure described above, when, as a result of some cause, a state is reached in which the amount of steam used for cooling is insufficient and the necessary amount of steam is not caused to flow, there are cases in which the difference in pressure detected by the pressure sensor remains below the predetermined value even if an inflow of low-temperature steam is caused by the temperature regulating valve. In such cases, the controller controls opening operation of the bypass valve, the cooling steam outlet side flow path of the combustor is placed in communication with the condenser, and the pressure difference between the cooling steam inlet side flow path and outlet side flow path of the combustor is forcibly increased, so that steam is caused to flow, and thus it is possible to prevent an excessive increase in the temperature of the steam flowing through the cooling steam outlet side flow path of the gas turbine combustor even during the starting of plant or during periods of load fluctuation, and thus to conduct control at planned values.

Another mode of the invention of the present application comprises a steam-cooling system for gas turbine combustors, wherein, in the state in which the temperature regulating valve is opened, if the temperature detected by the temperature sensor is not reduced to a predetermined value, the controller conducts control so as to open the bypass valve.

In the structure described above, the temperature at the cooling steam outlet side flow path of the combustor is detected, so that the controller first controls opening operation of the temperature control valve, and in cases in which this control is insufficient, next controls opening operation of the bypass valve. Furthermore, in cases in which the difference in pressure between the cooling steam inlet side flow path and outlet side flow path of the combustor is low, this bypass valve is opened irrespective of the steam temperature in the vicinity of the outlet of the combustor. Accordingly, using both values detected by the pressure sensor and the temperature sensor, the controller controls the bypass valve, so that the reliability of control is improved.

BEST MODE FOR CARRYING OUT THE INVENTION

Hereinbelow, embodiments of the present invention will be explained concretely based on the figures.

Figure 1:
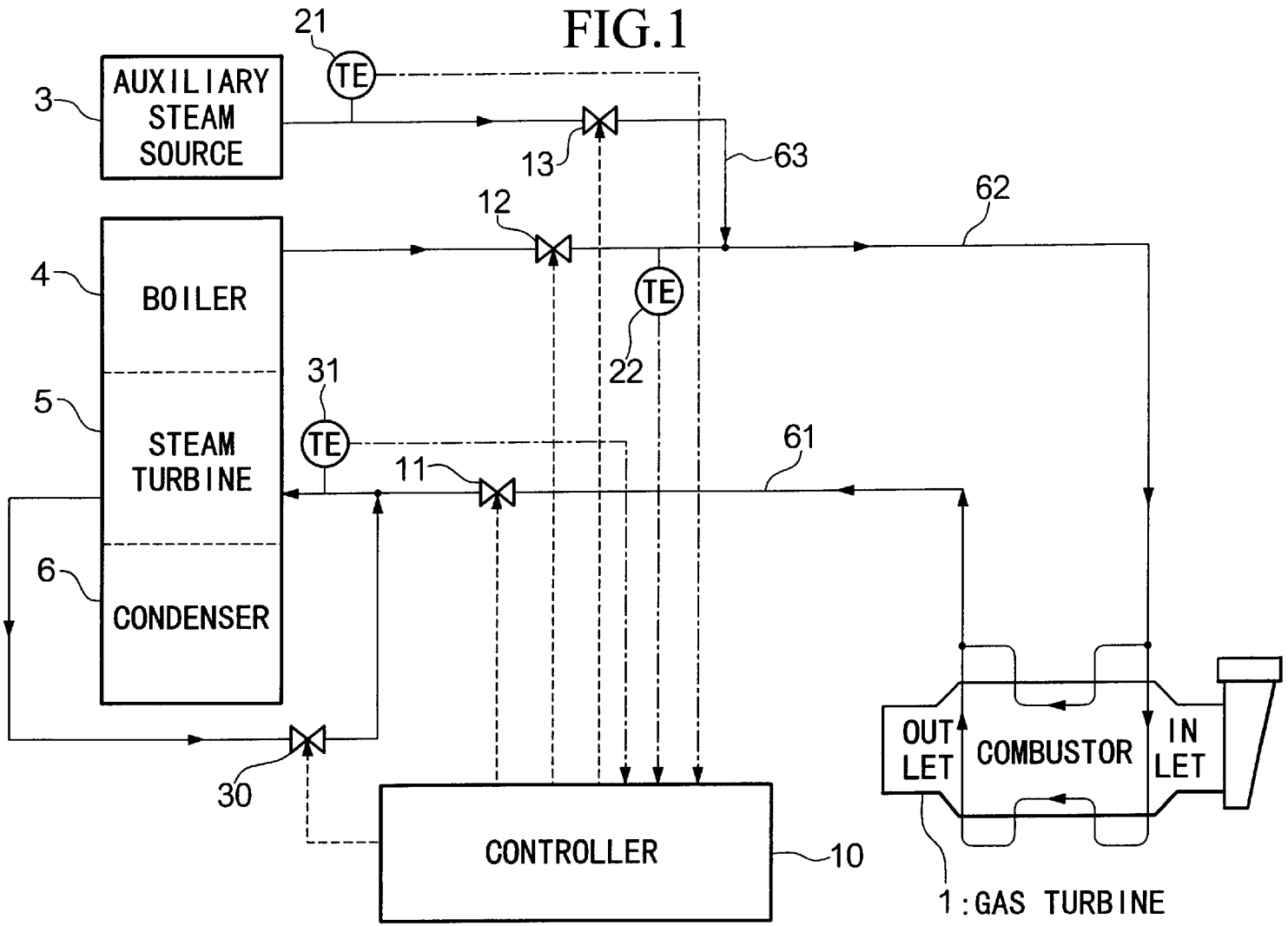
FIG. 1 is a schematic flow diagram showing a steam-cooling system for gas turbine combustors in accordance with an embodiment of the present invention.

FIG. 1 is a schematic flow diagram of a steam-cooling system for gas turbine combustors in accordance with an embodiment of the present invention. In FIG. 1, references 1, 3 through 6, 11 through 13, and 21 through 22 have functions identical to those in the conventional example shown in FIG. 6, and a detailed description thereof will be omitted here, and they simply will be described by reference. Furthermore, the characteristic parts of the present invention are those given reference numbers 10, 30, and 31, and these will be described in detail hereinbelow.

In FIG. 1, controller 10 conducts control so as to open the auxiliary steam valve 13 prior to the starting, similar to the above-mentioned conventional example, and auxiliary steam flows from auxiliary steam source 3 into auxiliary steam flow path 63, and the steam is led to the combustor of gas turbine 1 via flow path 62, and is discharged via a flush pipe which is not depicted in the figure, so that a warming up is conducted. Next, the starting of gas turbine 1 is conducted, and after a predetermined period of time, auxiliary steam valve 13 is closed, and steam valve 12 is simultaneously opened, and steam recovery valve 11 is also opened and the extracted steam from boiler 4 is supplied to the combustor of gas turbine 1, the combustor is cooled, and after being used for cooling, the steam is returned to steam turbine 5 via cooling steam outlet side flow path 61. As a concrete example of this case, the steam from boiler 4 is extracted from the outlet of an IPSH (intermediate pressure super heater), and the recovered steam is returned to an HTR (high-temperature steam reheater).

Figure 6:
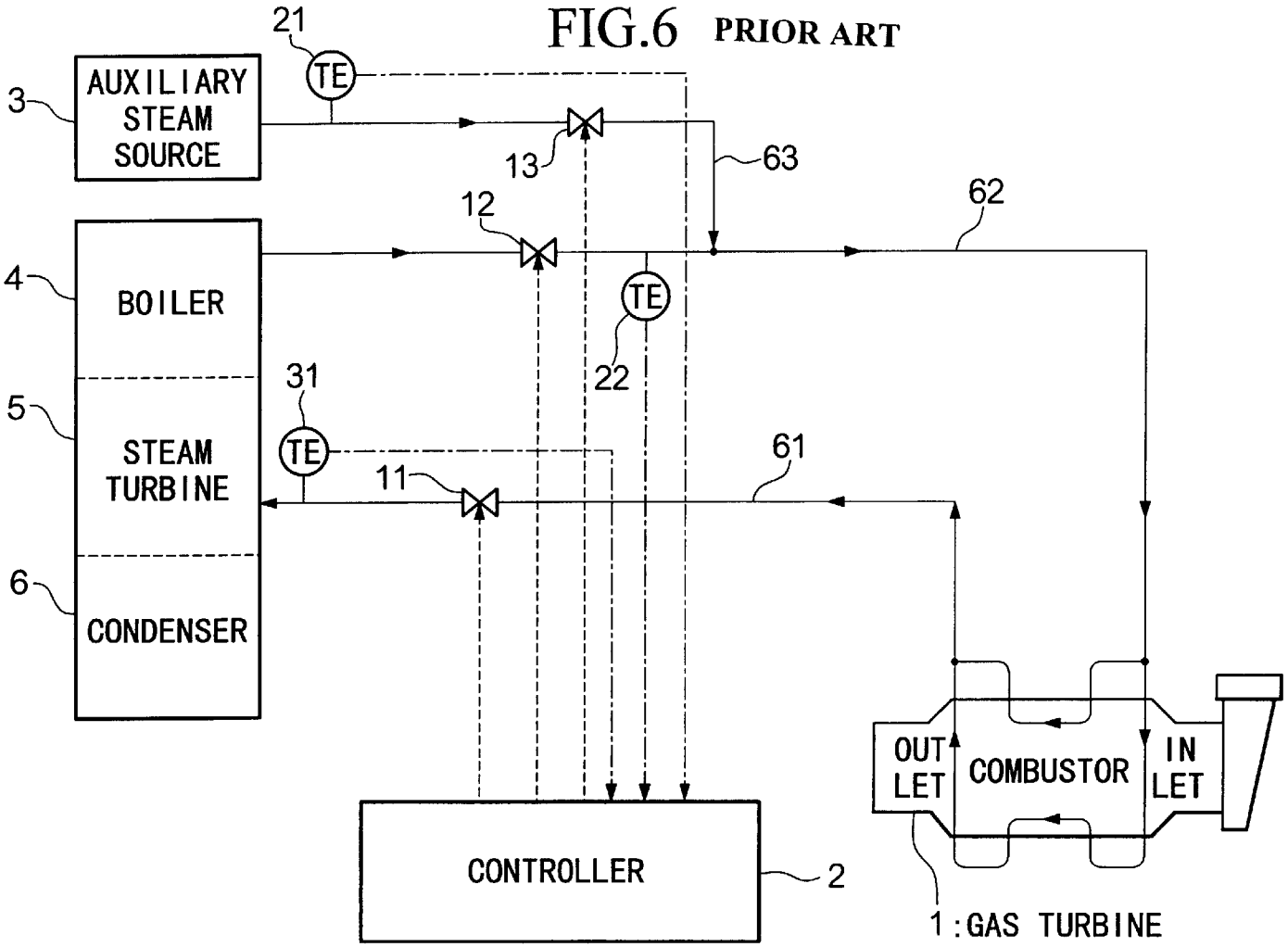
FIG.6 PRIOR ART
FIG. 6 is a schematic flow diagram of a conventional steam-cooling system for gas turbine combustors.
Figure 7:
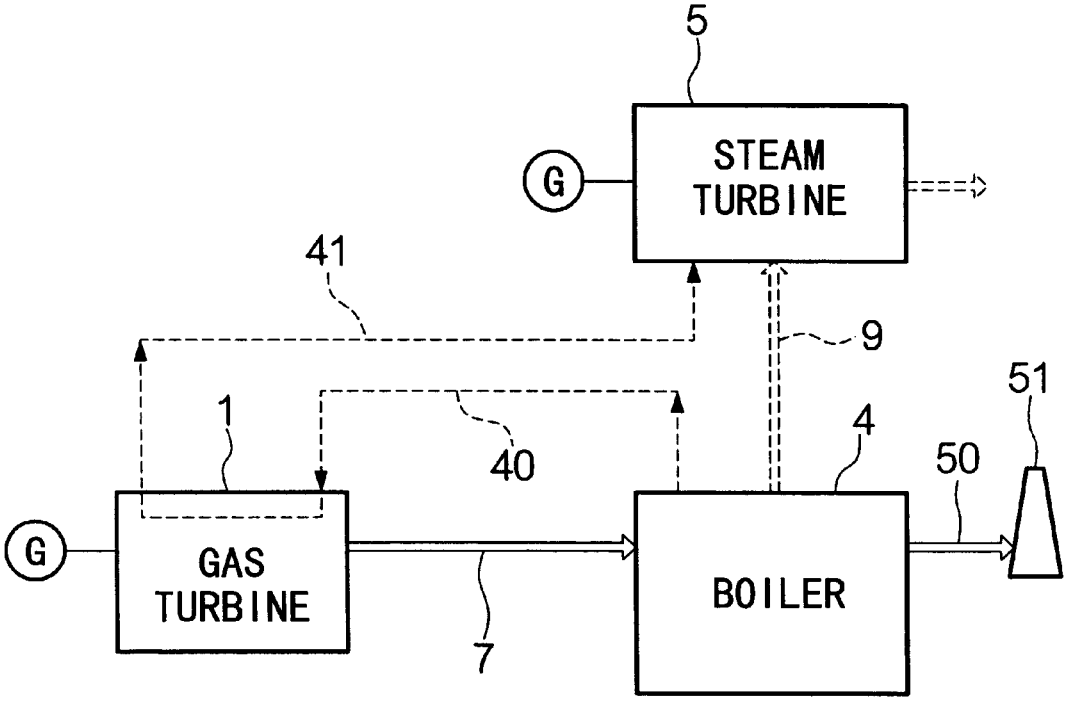
FIG.7 PRIOR ART
FIG. 7 is a schematic diagram of a combined plant which is provided with a conventional steam-cooled combustor.

The control described above is similar to that of the conventional example shown in FIG. 6; however, the present invention is further provided with the following functions.

Controller 10 controls the amount of steam required for combustor cooling in accordance with the starting of plant or during changes in the load during periods of load fluctuation; however, such control does not immediately reflect the pressures and temperatures of the steam generated in the boiler, but rather a delay is produced, and as a result of this delay, there are cases in which the cooling steam for the combustor is insufficient and the steam temperature at the combustor outlet is in excess of the planned temperature.

The temperature signal of temperature sensor 31 is input at the controller 10, and when the detected temperature exceeds a planned temperature which is set in advance, the controller 10 conducts control such that the temperature valve 30 is opened. By means of opening the temperature valve 30, the exhaust gas from steam turbine 5, that is to say, low-temperature reheated steam, is extracted, and this is injected into the flow path 61 at the recovered steam side, that is to say, the cooling steam outlet side of the combustor. By means of this controller 10, the temperature of the steam at the combustor outlet side, which had become high, is regulated and the temperature thereof decreases, and when this reaches the planned temperature, control is conducted so that the temperature regulation valve 30 is closed, and the control of normal operations is resumed.

Figure 2:
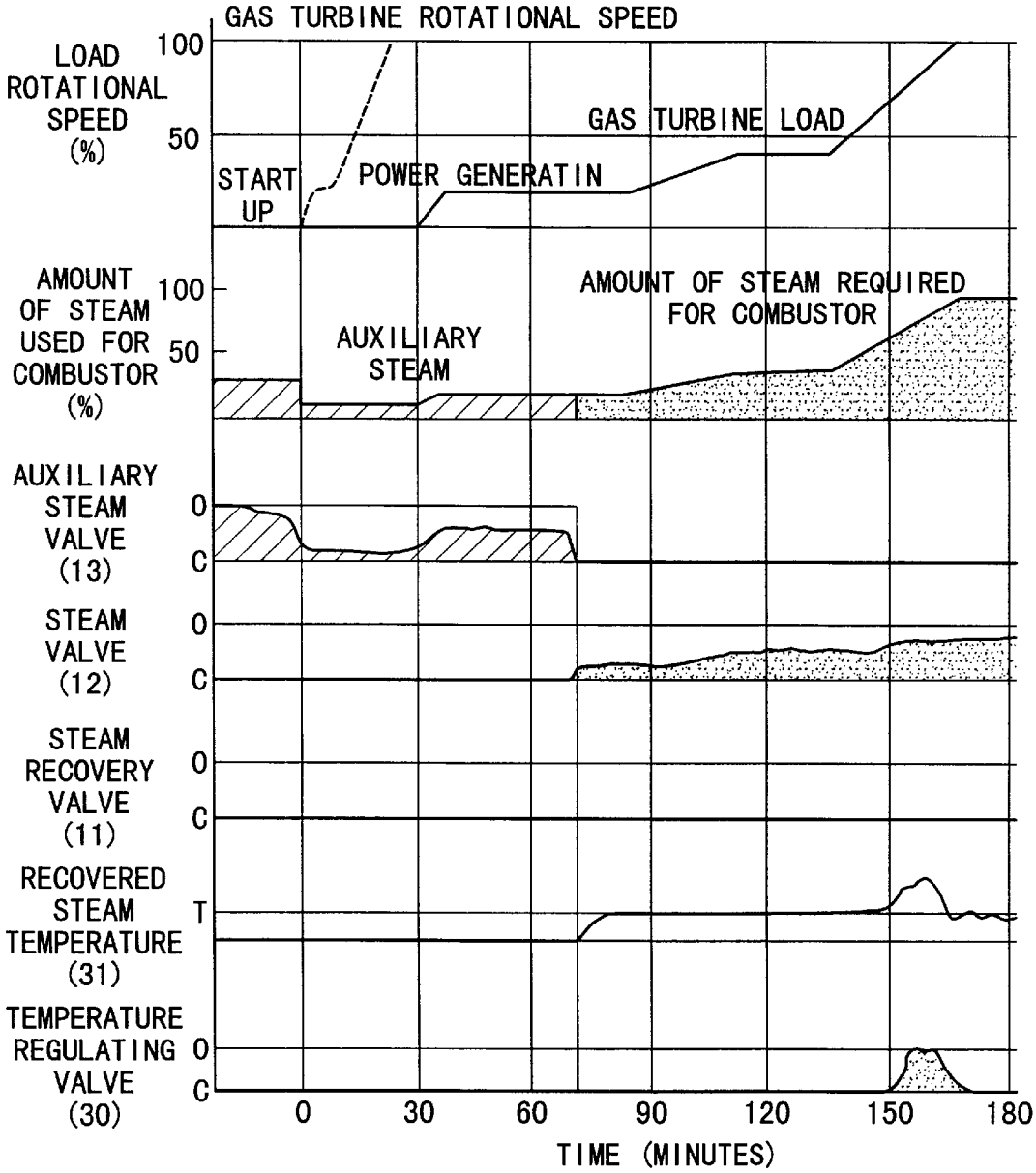
FIG. 2 is a timing chart of the control of the steam-cooling system for gas turbine combustors in accordance with an embodiment of the present invention.

FIG. 2 is a timing chart of the control in an actual embodiment of the explanation above. In the figure, the uppermost level indicates the patterns of the rotation and load of gas turbine 1; the load of gas turbine 1 increases slowly from a period of 30 minutes after the starting, and at some point after the passage of 150 minutes it reaches 100%. The controller 10, in accordance with the load pattern, maintains auxiliary steam valve 13 in an open state prior to the starting of gas turbine 1 and for a period of more than 60 minutes after the starting thereof; the auxiliary steam from auxiliary steam source 3 is let into flow path 62. Furthermore, the amount of steam necessary for the combustor after the supply of auxiliary steam is also set in accordance with this load pattern. The controller 10 opens steam valve 12 and steam recovery valve 11 simultaneously with the closing of auxiliary steam valve 13; by allowing steam from boiler 4 to enter flow path 62 in accordance with the pattern of the amount of steam required for the combustor, the combustor is cooled. After it is used for cooling, this steam is returned to steam turbine 5 via steam recovery valve 11.

Furthermore, the recovered steam temperature (combustor outlet temperature) of the temperature sensor 31 experiences a transition at the planned temperature; however, when there is a sudden increase in the load at some point after the passage of 150 minutes, as a result of the delay in the supply of steam and the like, the steam temperature rises above the planned temperature T. At this time, the controller 10 opens the temperature regulating valve 30, and the exhaust gas from steam turbine 5, that is to say, the low-temperature reheated steam, is extracted, and this is let into the cooling steam outlet side flow path 61 of the combustor and the temperature is regulated, and when the temperature returns to the planned value, the temperature regulating valve 30 is closed, and normal control is resumed.

In accordance with the above embodiment of the present invention, in a steam-cooling system for gas turbine combustors, a temperature sensor 31 and a temperature regulating valve 30 are provided in order to prevent an excessive increase in the steam temperature at the outlet of the combustor, and control is exerted by the controller 10, and a portion of the exhaust gases of the steam turbine 5 are extracted and returned to the combustor outlet side, so that it is possible to control the temperature at the outlet of the combustor of gas turbine 1 at planned values even during the starting of plant or during periods of load change, and furthermore, in order to respond to insufficiencies in the steam used for combustor cooling, it is not necessary to increase the size of the boiler.

Figure 3:
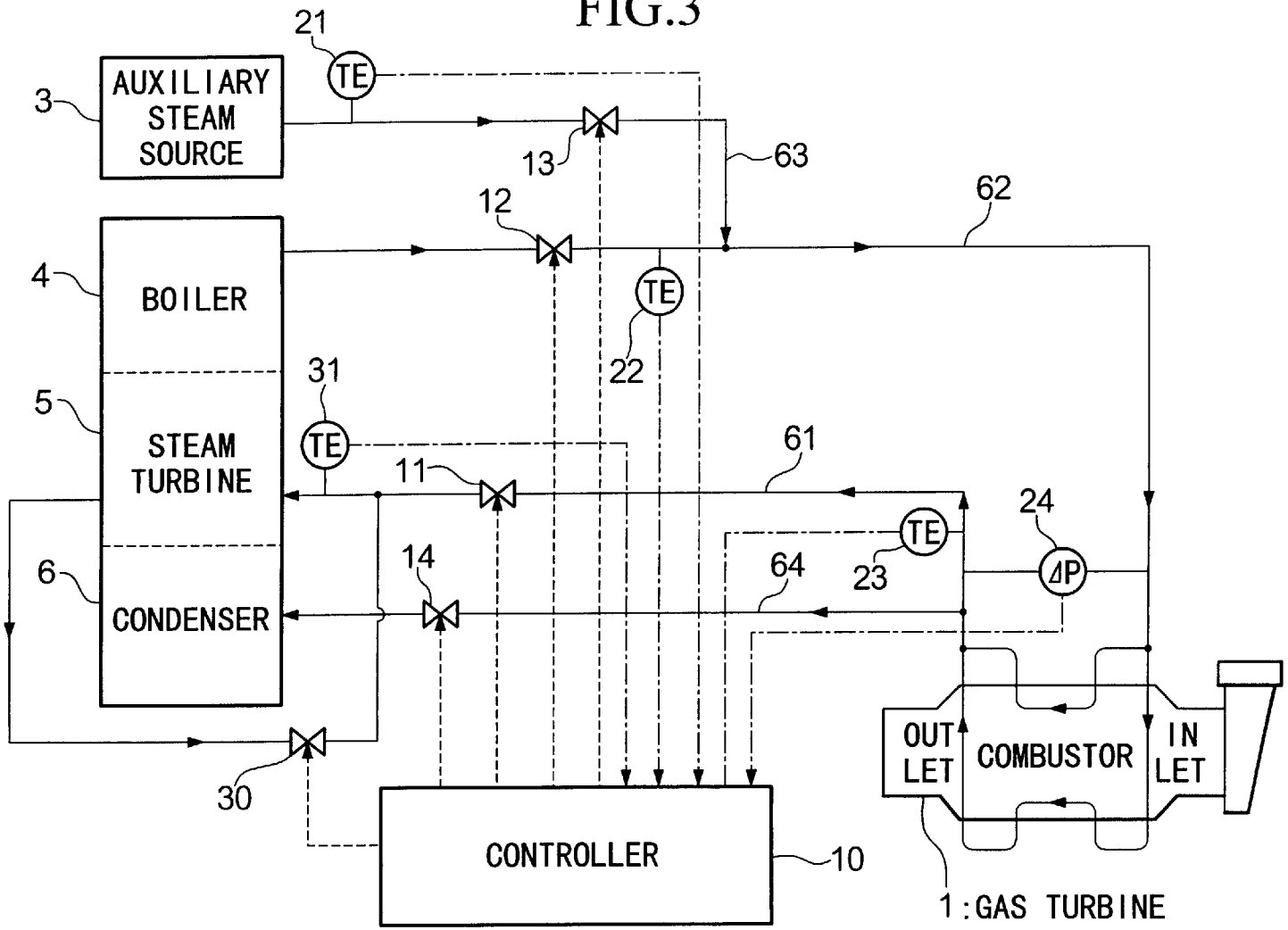
FIG. 3 is a schematic flow diagram of a steam-cooling system for gas turbine combustors in accordance with a further embodiment of the present invention.

FIG. 3 is a schematic flow diagram of a steam-cooling system for gas turbine combustors in accordance with another embodiment of the present invention; those parts having identical reference numbers as in FIG. 1 have the same function. A temperature sensor 23 for detecting the steam temperature at the combustor outlet is provided in the vicinity of the combustor outlet in the flow path 61 at the cooling steam outlet side of the combustor, and a bypass valve 14 is placed in the flow path 64 (the bypass path) which leads to the condenser from the vicinity of the outlet of the combustor in flow path 61 at the cooling steam outlet side of the combustor, and the values detected by the temperature sensor 23 are transmitted to the controller 10. Furthermore, a pressure sensor 24 for detecting the difference in pressure between the steam inlet side flow path 62 and the steam outlet side flow path 61 of the combustor is installed between flow path 61 and flow path 62, and the value detected thereby is transmitted to controller 10.

Controller 10 conducts the following control, which is a characteristic feature of the present invention. In other words, when the pressure difference detected by pressure sensor 24 at the combustor outlet of gas turbine 1 is small, the necessary amount of steam is not flowing to the combustor, so that the temperature of temperature sensor 31 also increases, and in such a case, in order to guarantee the necessary amount of steam to the combustor, controller 10 controls opening operation of the bypass valve 14, and control is conducted so that steam flows to condenser 6 via bypass path 64. In this way, it is possible to prevent an excessive heating of the combustor by means of forcing a difference in pressure between the combustor outlet and inlet and causing a flow of steam.

Next, as a second embodiment, in the case in which the temperature of temperature sensor 31 is high, the temperature regulation valve 30 is first opened, and if control cannot be effected in this way, then the bypass valve 14 is also opened. Furthermore, when the difference in pressure between the cooling steam inlet side flow path 62 and outlet side flow path 61 of the combustor is low, then this bypass valve 14 is opened irrespective of the steam temperature of the cooling steam outlet side flow path 61 of the combustor detected by temperature sensor 31. Here, the temperature may be detected using the temperature sensor 23, which is provided in the vicinity of the combustor outlet in the cooling steam outlet side flow path 61 of the combustor, in place of the temperature sensor 31.

Figure 4:
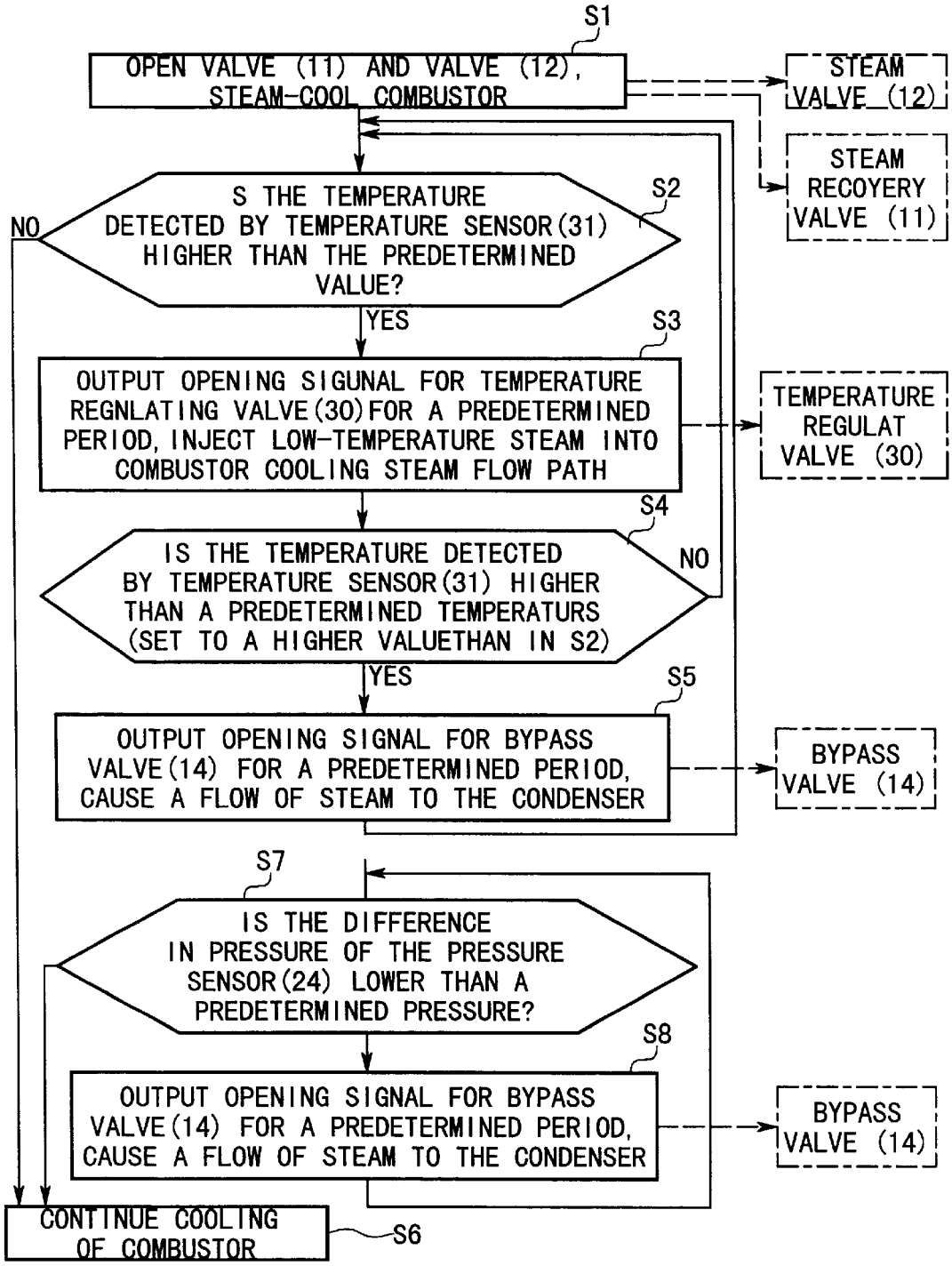
FIG. 4 is a flow chart of the characteristic portions of the controller of the present invention in a steam-cooling system for gas turbine combustors in accordance with a further embodiment of the present invention.

FIG. 4 is a flow chart showing, among the control conducted by controller 10, the parts which are characteristic of the present invention. In S1, the cooling of the combustor by steam is conducted, steam valve 12 is opened and steam is led from boiler 4 to the combustor, the combustor is cooled, and the steam is recycled to steam turbine 5 via steam recovery valve 11.

In S2, during cooling, if the temperature detected by temperature sensor 31 increases and becomes greater than a prespecified temperature, the temperature of the combustor increases, and the steam used for cooling will be insufficient, so that a determination is made as to whether the combustor temperature is increasing, and in S3, temperature regulation valve 30 is opened, and low-temperature steam from steam turbine 5 is injected into the cooling steam outlet side flow path 61 of the combustor.

In S4, cases are observed in which, irrespective of the fact that in S3 low-temperature steam was injected into the steam flow path of the combustor for a predetermined period of time by means of temperature regulating valve 30, the steam flow rate to the combustor is insufficient, and the temperature of the recovered steam increases. That is to say, a determination is made as to whether the temperature detected by temperature sensor 31 is higher than the temperature detected by temperature sensor 31 in S2, and when it is higher, bypass valve 14 is opened for a predetermined period of time in S5, steam from the cooling steam outlet side flow path 61 of the combustor is caused to flow to the condenser 6, and the pressure difference between the cooling steam inlet side flow path 62 and outlet side flow path 61 of the combustor is forcibly increased and steam is caused to flow, thus preventing the overheating of the combustor. Here, the temperature in the vicinity of the outlet of the combustor may be detected using the temperature sensor 23 in place of the temperature sensor 31, and a determination may be made in S2 as to whether this temperature is higher than the temperature detected by temperature sensor 31, and the same control may be conducted.

In S6, in the case in which the temperature detected by temperature sensor 31 in S2 above is unchanged, or in S7, in the case in which the detected value is unchanged, the cooling of the combustor is continued.

In S7, further, a determination is made as to whether the difference in pressure of the pressure sensor 24 is lower than a predetermined pressure, and when it is lower, the bypass valve 14 is opened in S8, and steam is caused to flow to the condenser 6.

Figure 5:
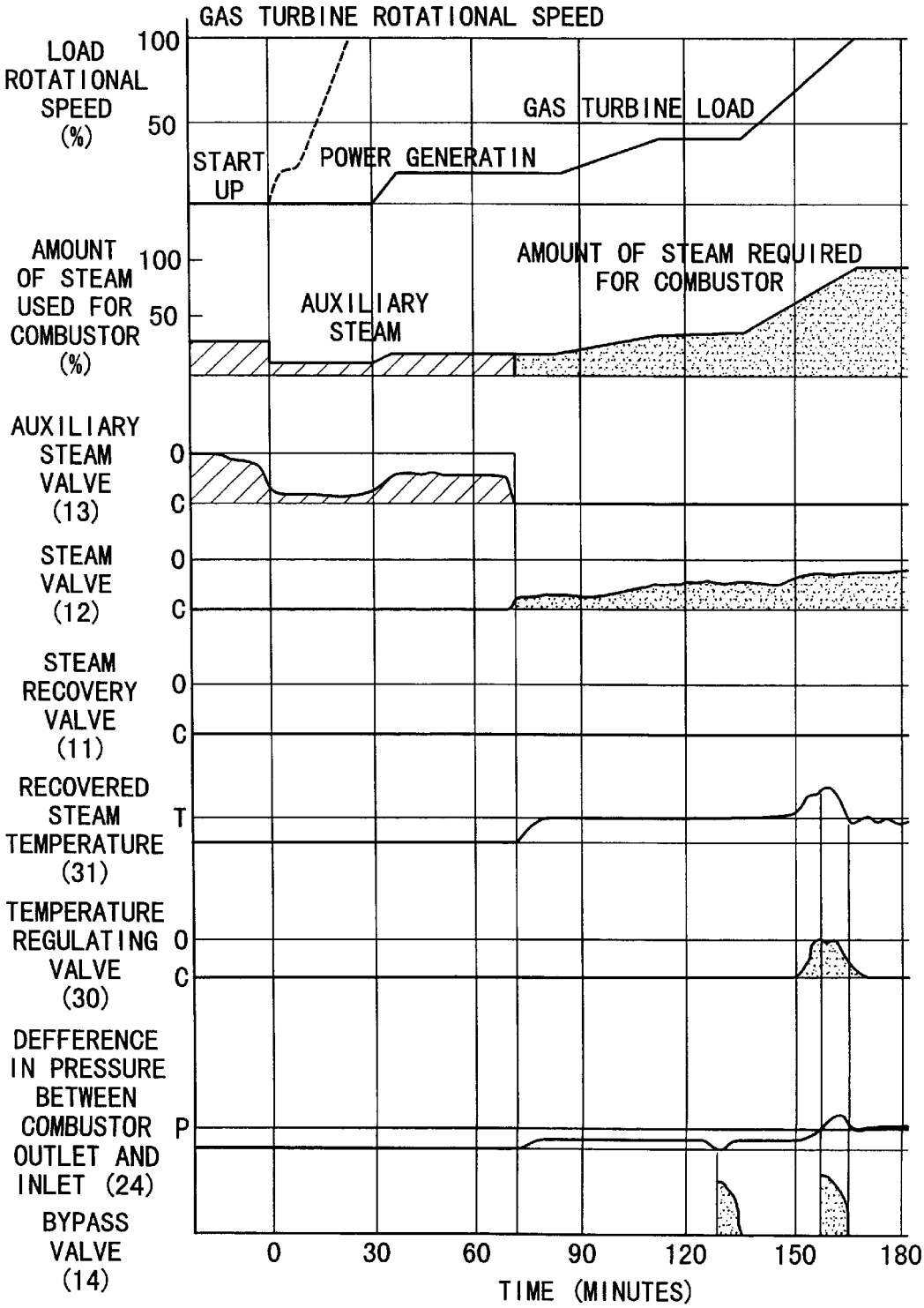
FIG. 5 is a timing chart of the control of the steam-cooling system for gas turbine combustors in accordance with a further embodiment of the present invention.

FIG. 5 is a timing chart of the control in the embodiment of the explanation above. In the figure, the uppermost level shows the pattern of the rotational speed and load of the gas turbine 1; the load of gas turbine 1 exhibits a pattern such that it slowly increases after a period of 30 seconds from starting, and reaches a level of 100% at a point after the passing of 150 minutes. Controller 10, in accordance with this load pattern, maintains the auxiliary steam drive 13 in an opened state from before the starting of gas turbine 1 to a point in time after the passage of 60 minutes or more from the starting, and causes an inflow of auxiliary steam from the auxiliary steam source 3 into flow path 62. Furthermore, the amount of steam necessary for the combustor after the supply of this auxiliary steam is also set in accordance with the load pattern.

Controller 10 controls opening operation of steam valve 12 and steam recovery valve 11 simultaneously with the closing of auxiliary steam valve 13, and by means of causing an inflow of steam from boiler 4 into flow path 62 in accordance with the pattern of the necessary amount of steam for the combustor, the combust or is cooled. After being used for cooling, the steam is recycled to steam turbine 5 via steam recovery valve 11.

Furthermore, the recovered steam temperature (combustor outlet temperature) of temperature sensor 31 experiences a transition at a planned temperature at a point up to 150 minutes after the starting; however, during the rapid increase in the load after 150 minutes of operation, as a result of the delay in the supply of steam and the like, the steam temperature exceeds the planned temperature T. At this time, controller 10 controls opening operation of temperature regulating valve 30, and the exhaust gas from steam turbine 5, that is to say, the low-temperature reheated steam, is extracted, and this is injected into the cooling steam outlet side flow path 61 of the combustor, and the temperature is regulated, and when the temperature return s to the planned value, the temperature regulating valve 30 is closed, and normal control is resumed. Up to this point, the operation is identical to that established in FIGS. 1 and 2.

Here, when the difference in pressure between the inlet side flow path 62 and the outlet side flow path 61 of the cooling steam of the combustor, which is detected by pressure sensor 24, is lower than a predetermined value, bypass valve 14 is opened irrespective of the steam temperature at the cooling steam outlet side flow path 61 of the combustor detected by temperature sensor 31.

In accordance with a further embodiment of the present invention, in a steam-cooling system for gas turbine combustors, a temperature sensor 31 and a temperature regulating valve 30 are provided in order to prevent an excessive increase in the steam temperature at the combustor outlet, and by means of controller 10, a portion of the steam discharged from steam turbine 5 is extracted and this is returned to the combustor outlet. Furthermore, in addition to this control, temperature sensor 23, pressure sensor 24, and bypass valve 14 are provided and the steam outputted by the combustor is caused to flow out to condenser 6. It is possible to control the outlet temperature of the combustor of gas turbine 1 at planned values even during the starting of plant and during periods of load change, and furthermore, it is not necessary to install a larger boiler in order to address insufficiencies in the steam used to cool the combustor.

INDUSTRIAL APPLICABILITY

In accordance with the structure described above, when the steam temperature in the cooling steam outlet side flow path of a combustor of a gas turbine increases, low-temperature steam discharged from the steam turbine discharge system is extracted, and this is injected into the cooling steam outlet side flow path, and it thus becomes possible to regulate the steam temperature, and furthermore, even if for some reason the amount of cooling steam decreases, tending to lead to an increase in the temperature of the combustor, the cooling steam outlet side flow path of the combustor is placed in communication with the condenser by opening a bypass valve, and the difference in pressure between the cooling steam inlet side flow path and outlet flow path of the combustor is increased, and control is conducted such that steam is caused to flow, so that it is possible to control the steam temperature in the cooling steam outlet side flow path of the combustor of a gas turbine at planned values without an excessive increase therein even during the starting or during periods of load change.

Furthermore, in the state in which the temperature regulating valve is opened, if the temperature detected by the sensor drops below a predetermined value, the controller opens the bypass valve, and thereby, in addition to the value detected by the pressure sensor, control is conducted while detecting the temperature of the cooling steam outlet side flow path of the combustor as well, so that the reliability of control is increased.

What is claimed is:

1. A steam-cooling system for gas turbine combustors in combined plants, in which combustion gas exhausted from a gas turbine is directed to a boiler, steam is generated in the boiler, and a steam turbine is driven using this steam while a part of the steam from the boiler is extracted and supplied to the gas turbine combustor to cool the combustor, and after being used for this cooling, the steam is returned to the steam turbine; which comprises:

a temperature sensor for detecting the temperature of steam in a cooling steam outlet side flow path of the gas turbine combustor;

a steam flow path through which steam is extracted from an exhaust system of the steam turbine and the extracted steam from the steam turbine is let into the cooling steam outlet side flow path of the gas turbine combustor via a temperature regulating valve; and a controller which receives detected temperature signals from the temperature sensor and conducts control such that the valve is opened when the detected temperature is in excess of a predetermined value, and closed when this temperature is equal to or lower than the predetermined value.

2. A steam-cooling system for gas turbine combustors in accordance with claim 1, comprising a pressure sensor for detecting a difference in pressure between an inlet side flow path and the outlet side flow path of the cooling steam of the combustor, and a bypass flow path for allowing an outflow of steam from the cooling steam outlet side flow path of the combustor to a condenser via a bypass valve; and a detected temperature signal from the temperature sensor and a pressure signal from the pressure sensor are input into the controller, and the controller conducts control such that when the detected temperature is higher than a predetermined value, the temperature regulating valve is opened, while when this temperature is equal to or lower than the predetermined value, the valve is closed, and furthermore conducts control such that when the detected pressure is lower than a predetermined value, the bypass valve is opened, while when the predetermined value is reached, the bypass valve is closed.

3. A steam-cooling system for gas turbine combustors in accordance with claim 2, wherein, in the state in which the temperature regulating valve is opened, if the temperature detected by the temperature sensor is not reduced to a predetermined value, the controller conducts control so as to open the bypass valve.

* * * * *